US008360888B2

(12) United States Patent
Phan et al.

(10) Patent No.: US 8,360,888 B2
(45) Date of Patent: Jan. 29, 2013

(54) EXTERNAL CONTROL OF A PERIPHERAL DEVICE THROUGH A COMMUNICATION PROXY IN A WAGERING GAME SYSTEM

(75) Inventors: Matthew Huy-Gia Phan, Las Vegas, NV (US); Jorge Luis Shimabukuro, Las Vegas, NV (US); Jun Wang, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 494 days.

(21) Appl. No.: 12/442,296

(22) PCT Filed: Oct. 26, 2007

(86) PCT No.: PCT/US2007/022756
§ 371 (c)(1),
(2), (4) Date: Mar. 20, 2009

(87) PCT Pub. No.: WO2008/057294
PCT Pub. Date: May 15, 2008

(65) Prior Publication Data

US 2009/0247288 A1 Oct. 1, 2009

Related U.S. Application Data

(60) Provisional application No. 60/888,809, filed on Feb. 8, 2007, provisional application No. 60/863,267, filed on Oct. 27, 2006.

(51) Int. Cl.
*A63F 9/24* (2006.01)

(52) U.S. Cl. ..... 463/42

(58) Field of Classification Search ..... 463/42
See application file for complete search history.

(56) References Cited

U.S. PATENT DOCUMENTS

| | | | |
|---|---|---|---|
| 5,707,286 | A | 1/1998 | Carlson |
| 5,759,102 | A | 6/1998 | Pease et al. |
| 5,889,848 | A | 3/1999 | Cookson |
| 6,135,887 | A | 10/2000 | Pease et al. |
| 6,682,423 | B2 | 1/2004 | Brosnan et al. |
| 6,899,627 | B2 | 5/2005 | Lam et al. |
| 6,908,391 | B2 | 6/2005 | Gatto et al. |
| 6,916,247 | B2 | 7/2005 | Gatto et al. |
| 6,979,266 | B2 | 12/2005 | Lemay et al. |

(Continued)

FOREIGN PATENT DOCUMENTS

WO WO-2004075128 A1 9/2004

OTHER PUBLICATIONS

"International Search Report for Application No. PCT/US2007/22756, date mailed Apr. 30, 2008", 4 pgs.

(Continued)

*Primary Examiner* — N Drew Richards
*Assistant Examiner* — Yu-Hsi D Sun
(74) *Attorney, Agent, or Firm* — Schwegman Lundberg & Woessner, P.A.

(57) ABSTRACT

Example embodiments are directed to external control of peripheral devices through a communication proxy of an electronic wagering game machine in a wagering game network. In a particular embodiment, an electronic wagering game machine includes a central processing unit (CPU); at least one peripheral device in data communication with the CPU; and a data communication interface in data communication with the CPU to enable data communication with an external system via an external system interface, the data communication interface including a first communication mode to control data communication between the external system and the at least one peripheral device, the data communication interface including a second communication mode to enable a communication proxy that optionally relinquishes control of the data communication between the external system and the at least one peripheral device.

25 Claims, 7 Drawing Sheets

U.S. PATENT DOCUMENTS

| | | | | |
|---|---|---|---|---|
| 6,997,803 | B2 | 2/2006 | LeMay et al. | |
| 2003/0037040 | A1 * | 2/2003 | Beadles et al. | 707/1 |
| 2004/0082385 | A1 | 4/2004 | Silva et al. | |
| 2004/0166917 | A1 | 8/2004 | Lam et al. | |
| 2004/0166932 | A1 | 8/2004 | Lam et al. | |
| 2004/0254006 | A1 | 12/2004 | Lam et al. | |
| 2004/0254013 | A1 | 12/2004 | Quraishi et al. | |
| 2006/0068920 | A1 | 3/2006 | Lemay et al. | |

OTHER PUBLICATIONS

"Written Opinion of the International Searching Authority for Application No. PCT/US2007/22756, date mailed Apr. 30, 2008", 7 pgs.

* cited by examiner

EXTERNAL CONTROL OF A PERIPHERAL DEVICE THROUGH A COMMUNICATION PROXY IN A WAGERING GAME SYSTEM

CROSS-REFERENCE TO RELATED PATENT APPLICATIONS

This patent application is a U.S. National Stage Filing under 35 U.S.C. 371 from International Patent Application Serial No. PCT/US2007/022756, filed Oct. 26, 2007, and published on May 15, 2008, as WO 2008/057294 A2 and republished as WO 2008/057294 A3, which claims the benefit of the filing date of U.S. Provisional Patent Application Ser. No. 60/863,267, filed Oct. 27, 2006, and entitled, "EXTERNAL CONTROL OF A PERIPHERAL DEVICE THROUGH A COMMUNICATION PROXY IN A WAGERING GAME SYSTEM", and of U.S. Provisional Patent Application Ser. No. 60/888,809, filed Feb. 8, 2007, and entitled, "EXTERNAL CONTROL OF A PERIPHERAL DEVICE THROUGH A COMMUNICATION PROXY IN AN ELECTRONIC WAGERING GAME SYSTEM", the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

TECHNICAL FIELD

This application relates generally to wagering game systems. More particularly, example embodiments are directed to external control of peripheral devices through a communication proxy of a wagering game machine in a wagering game network.

BACKGROUND

Wagering game machine developers continually provide new and entertaining games. One way of increasing entertainment value associated with casino-style wagering games (e.g., video slots, video poker, video blackjack, and the like) includes offering a variety of base games and bonus events. However, despite the variety of base games and bonus events, players often lose interest in repetitive wagering gaming content. In order to maintain player interest, wagering game machine developers frequently update wagering game content with new game themes, game settings, bonus events, game software, and other electronic data.

When distributing new wagering game content to wagering game machines in the field, wagering game machine operators typically manually deliver the content to each wagering game machine. For example, when deploying new wagering game content, operators typically replace existing media (e.g., ROM, CD-ROM, or flash RAM) with new media containing updated wagering game content. For wagering game machine operators owning scores of machines, this process may be relatively laborious and expensive.

BRIEF DESCRIPTION OF THE DRAWINGS

Embodiments are illustrated by way of example and not limitation in the figures of the accompanying drawings in which.

DETAILED DESCRIPTION

Example Operating Environment

Example Wagering Game Machine Architecture

Figure 1:
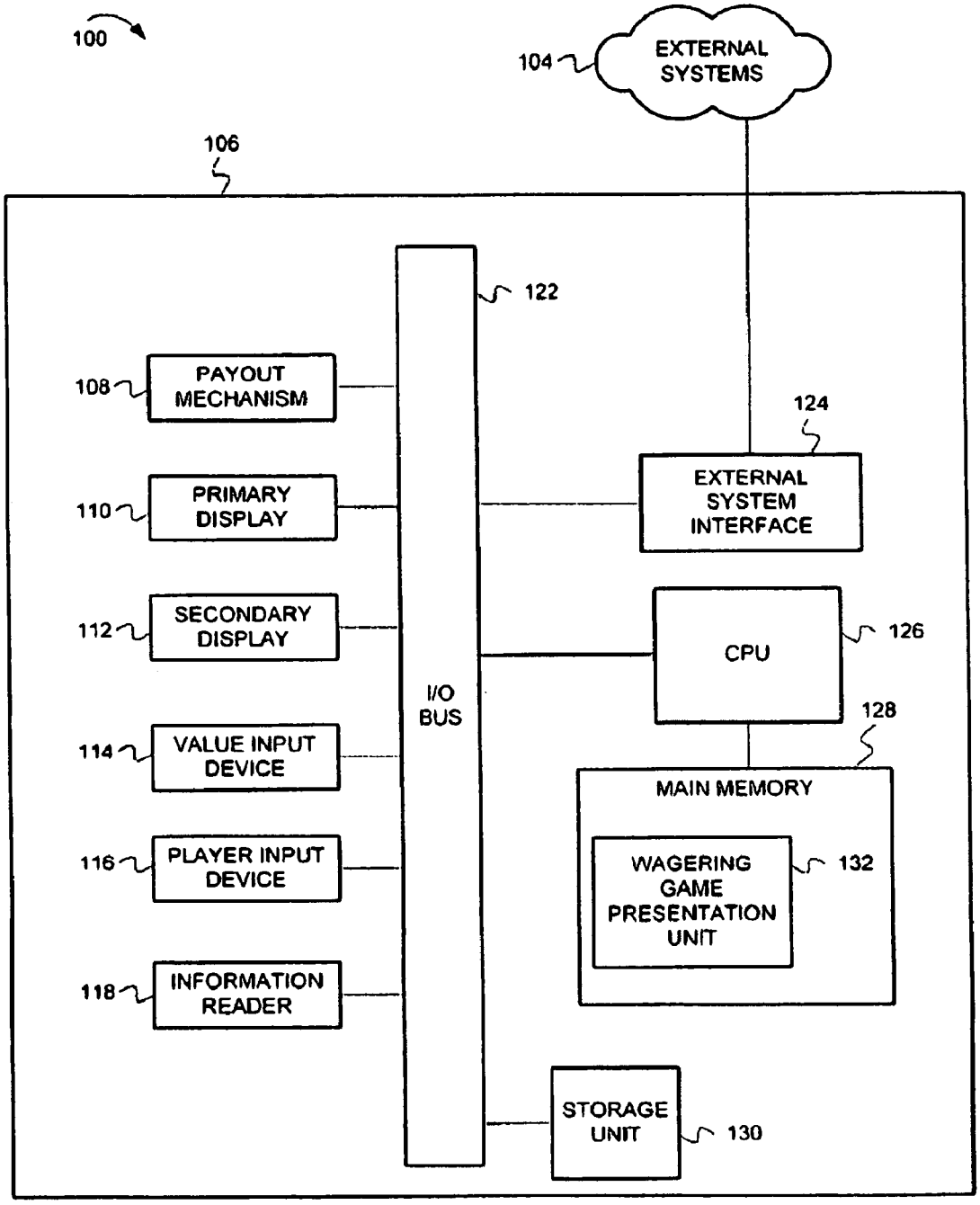
FIG. 1 is a block diagram illustrating an electronic wagering game machine architecture, including a control system, according to example embodiments of the invention.

FIG. 1 is a block diagram illustrating a wagering game machine (also denoted herein as an electronic wagering game machine (EGM)) architecture, including a control system, according to example embodiments of the invention. As shown in FIG. 1, the wagering game machine 106 includes a central processing unit (CPU) 126 connected to main memory 128, which includes a wagering game presentation unit 132. In one embodiment, the wagering game presentation unit 132 can present wagering games, such as video poker, video blackjack, video slots, video lottery, etc., in whole or part.

The CPU 126 is also connected to an input/output (I/O) bus 122, which facilitates communication between the wagering game machine's components. The I/O bus 122 is connected to a payout mechanism 108, primary display 110, secondary display 112, value input device 114, player input device 116, information reader 118, and storage unit 130. The player input device 116 can include the value input device 114 to the extent the player input device 116 is used to place wagers. The I/O bus 122 is also connected to an external system interface 124, which is connected to external systems 104 (e.g., wagering game networks).

In one embodiment, the wagering game machine 106 can include additional peripheral devices and/or more than one of each component shown in FIG. 1. For example, in one embodiment, the wagering game machine 106 can include multiple external system interfaces 124 and multiple CPUs 126. In one embodiment, any of the components can be integrated or subdivided. Additionally, in one embodiment, the components of the wagering game machine 106 can be interconnected according to any suitable interconnection architecture (e.g., directly connected, hypercube, etc.).

In one embodiment, any of the components of the wagering game machine 106 can include hardware, firmware, and/or software for performing the operations described herein. Machine-readable media includes any mechanism that provides (e.g., stores and/or transmits) information in a form readable by a machine (e.g., an electronic wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
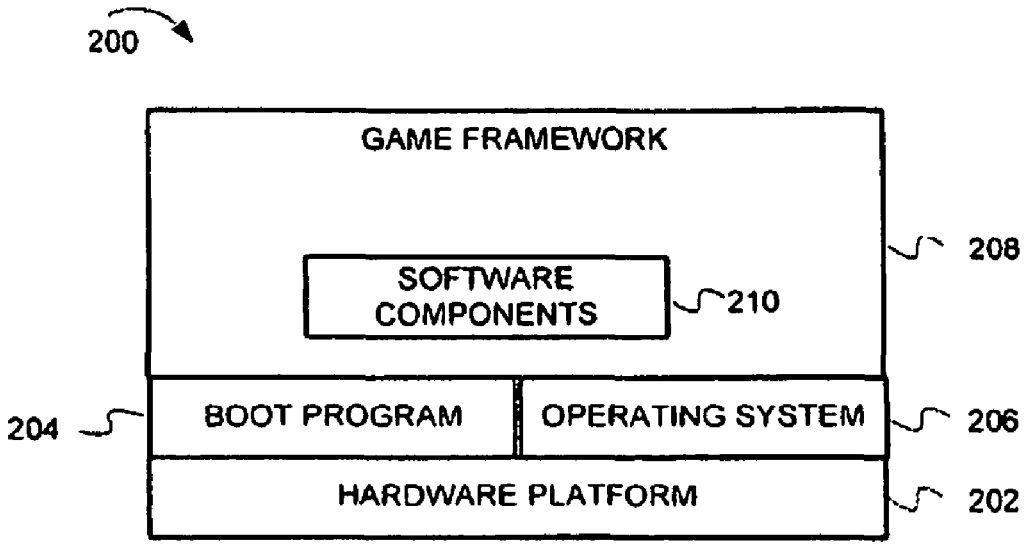
FIG. 2 illustrates a block diagram of an architecture for an electronic wagering game machine according to example embodiments of the inventive subject matter.

Referring now to FIG. 2, there is illustrated a block diagram of an architecture for an electronic wagering game machine 200, according to example embodiments of the inventive subject matter. As shown in FIG. 2, the wagering game architecture includes a hardware platform 202, a boot program 204, an operating system 206, and a game framework 208 that includes one or more wagering game software components 210. In various embodiments, the hardware platform 202 may include a thin-client, thick-client, or some intermediate derivation. The hardware platform 202 may also be configured to provide a virtual client. The boot program 204 may include a basic input/output system (BIOS) or other initialization program that works in conjunction with the operation system 206 to provide a software interface to the hardware platform 202. The game framework 208 may include standardized game software components either independent or in combination with specialized or customized game software components that are designed for a particular wagering game. In one example embodiment, the wagering game software components 210 may include software operative in connection with the hardware platform 202 and operating system 206 to present wagering games, such as video poker, video black jack, video slots, video lottery, etc., in whole or part. According to another example embodiment, the software components 210 may include software operative to accept a wager from a player. According to one example embodiment, the game software components 210 include one or more components to facilitate external control of peripheral devices through a communication proxy of an electronic wagering game machine in a wagering game network. According to another example embodiment, one or more of the software components 210 may be provided as part of the operating system 206 or other software used in the wagering game system 200 (e.g., libraries, daemons, common services, etc.).

Figure 3:
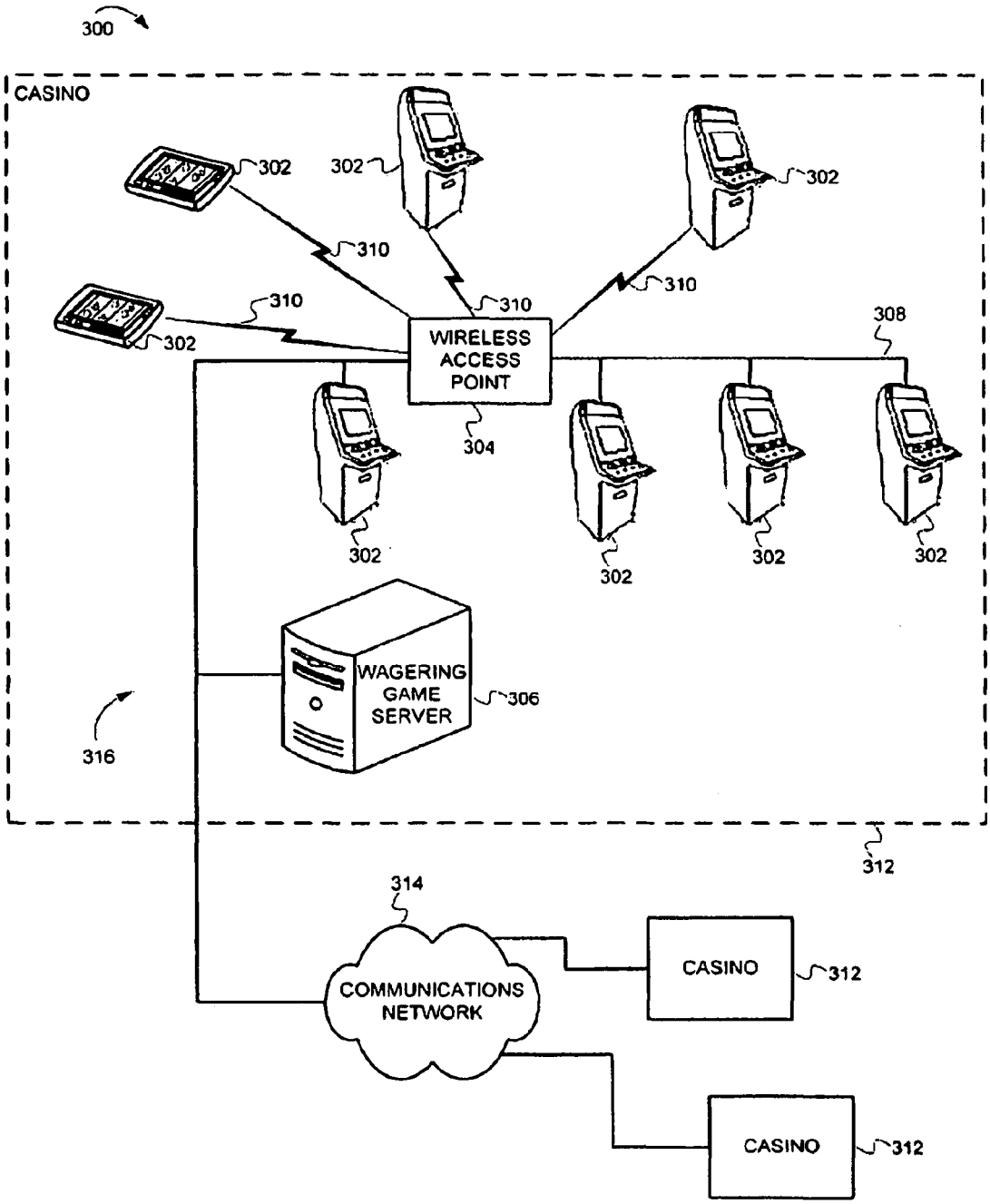
FIG. 3 is a block diagram illustrating a wagering game network according to example embodiments of the invention.

While FIGS. 1 and 2 describe example embodiments of an electronic wagering game machine architecture, FIG. 3 shows how a plurality of wagering game machines can be connected in a wagering game network.

Example Wagering Game Network

FIG. 3 is a block diagram illustrating a wagering game network 300, according to example embodiments of the invention. As shown in FIG. 3, the wagering game network 300 includes a plurality of casinos 312 connected to a communications network 314.

Each of the plurality of casinos 312 includes a local area network 316, which may include a wireless access point 304, wagering game machines 302, and a wagering game server 306 that can serve wagering games over the local area network 316. As such, the local area network 316 includes wireless communication links 310 and wired communication links 308. The wired and wireless communication links can employ any suitable connection technology, such as Bluetooth, 802.11, Ethernet, public switched telephone networks, SONET, etc. In one embodiment, the wagering game server 306 can serve wagering games and/or distribute content to devices located in other casinos 312 or at other locations on the communications network 314.

The wagering game machines 302 and wagering game server 306 can include hardware and machine-readable media including instructions for performing the operations described herein.

The wagering game machines 302 described herein can take any suitable form, such as floor standing models, handheld mobile units, bartop models, workstation-type console models, etc. Further, the wagering game machines 302 can be primarily dedicated for use in conducting wagering games, or can include non-dedicated devices, such as mobile phones, personal digital assistants, personal computers, etc. In one embodiment, the wagering game network 300 can include other network devices, such as accounting servers, wide area progressive servers, player tracking servers, and/or other devices suitable for use in connection with embodiments of the invention.

In various embodiments, wagering game machines 302 and wagering game servers 306 work together such that a wagering game machine 302 may be operated as a thin, thick, or intermediate client. For example, one or more elements of game play may be controlled by the wagering game machine 302 (client) or the wagering game server 306 (server). Game play elements may include executable game code, lookup tables, configuration files, game outcome, audio or visual representations of the game, game assets or the like. In a thin-client example, the wagering game server 306 may perform functions such as determining game outcome or managing assets, while the wagering game machine 302 may be used merely to present the graphical representation of such outcome or asset modification to the user (e.g., player). In a thick-client example, game outcome may be determined locally (e.g., at the wagering game machine 302) and then communicated to the wagering game server 306 for recording or managing a player's account.

Similarly, functionality not directly related to game play may be controlled by the wagering game machine 302 (client) or the wagering game server 306 (server) in embodiments. For example, power conservation controls that manage a display screen's light intensity may be managed centrally (e.g., by the wagering game server 306) or locally (e.g., by the wagering game machine 302). Other functionality not directly related to game play may include presentation of advertising, software or firmware updates, system quality or security checks, etc.

Referring to FIGS. 4-7, the systems and methods of various embodiments described below allow an External System Server or Controller Program (e.g. bank or Casino level Host) to communicate with and control a peripheral device via a proxy communication link or interface provided by an electronic wagering game machine (EGM) processor (e.g. CPU) or other device in direct communication with the External System Server and the peripheral device.

Figure 4:
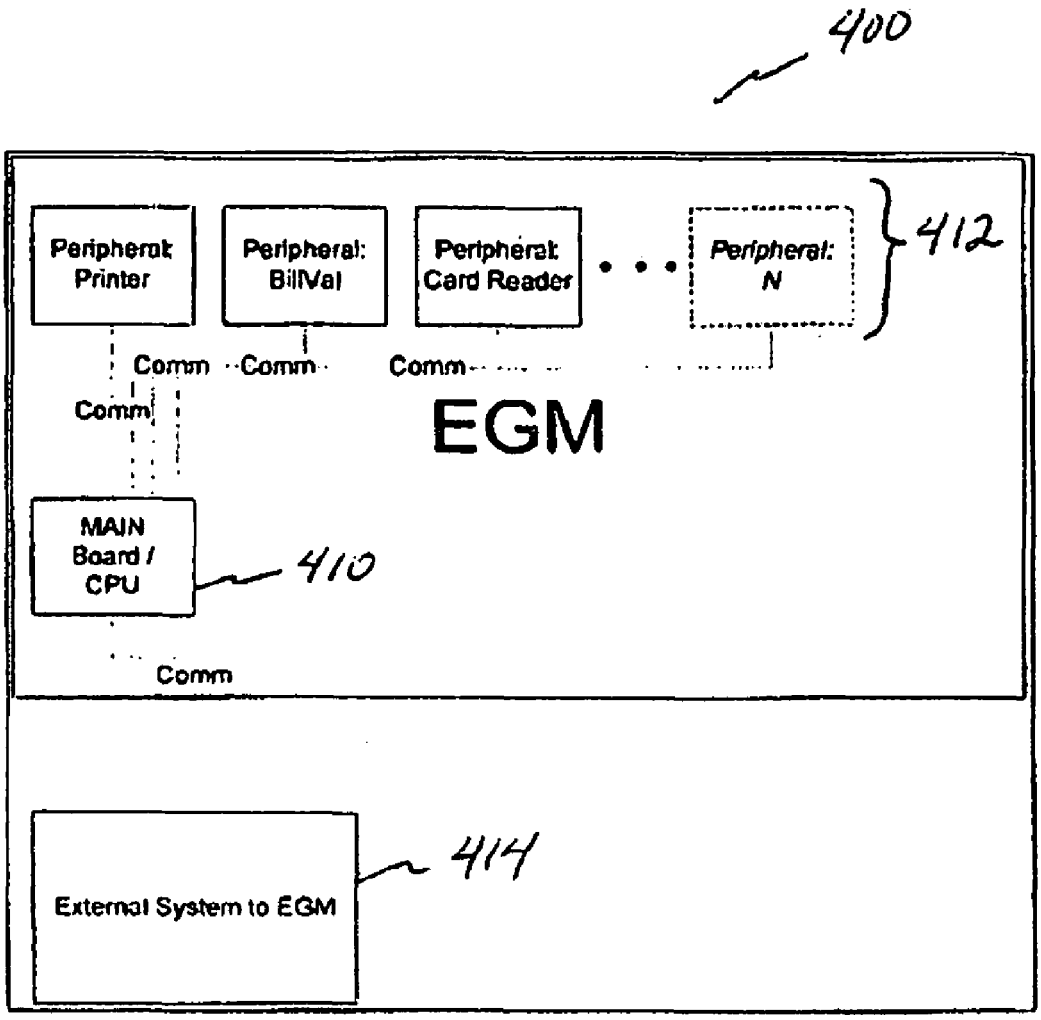
FIG. 4 illustrates an example embodiment of an electronic wagering game machine (EGM).

FIG. 4 illustrates an example embodiment of an electronic wagering game machine (EGM) 400, which includes a processor 410 in data communication with a plurality of peripheral devices 412 (e.g. a printer, a bill validation system, a card reader, touch screen device, etc). EGM 400 also includes a data communication interface to an external system interface 414. The external system interface 414 can be used to connect the EGM 400 to an External System, such as an External System Server or Controller Program (e.g. bank or Casino level Host). Note that data communications between processor 410, peripheral devices 412, and external system interface 414 may be implemented using conventional data communication technologies, including wired technologies such as USB, serial, parallel, Ethernet, Ethernet-Over-Power; or wireless technologies, such as Bluetooth, 802.11x, zigbee, wireless USB, and/or other forms of conventional wired, wireless, or optical data communication technologies.

Figure 5:
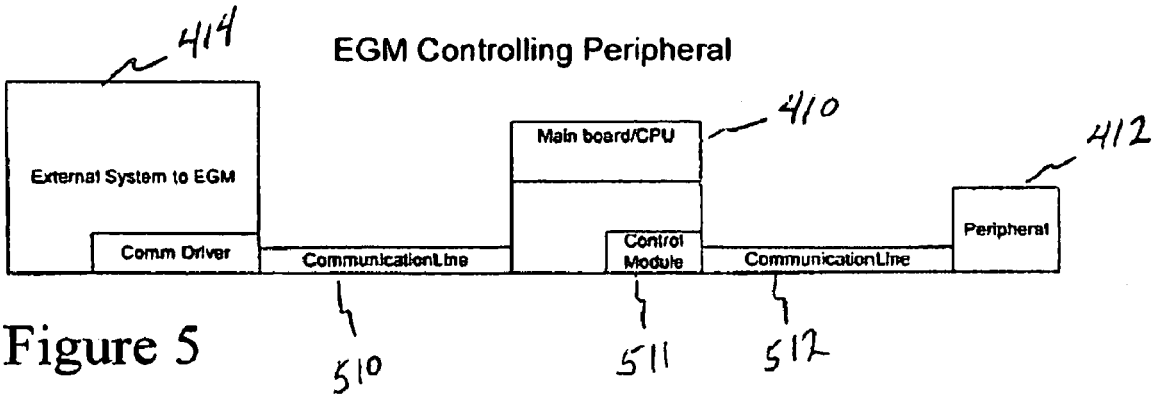
FIG. 5 illustrates a first communication mode between an external system and a peripheral device via a processor of the EGM.

Referring to FIG. 5, a first communication mode between the external system 414 and the peripheral device 412 via the processor 410 of EGM 400 is shown. In the first communication mode, the EGM 400 may directly interface with peripheral device 412 via communication line/links 510 and 512 and control module 511. Note that communication line/links 510 and/or 512 may be implemented using conventional data communication technologies, including wired technologies such as USB, serial, parallel, Ethernet, Ethernet-Over-Power; or wireless technologies, such as Bluetooth, 802.11x, zigbee, wireless USB, and/or other forms of conventional wired, wireless, or optical data communication technologies. In the first communication mode, the EGM 400 is configured to control or communicate with the peripheral device in a manner corresponding with the type of peripheral device and/or the type of functionality provided therein. In the first communication mode, the EGM 400 can be configured to simply forward messages or commands verbatim between the peripheral device and an external system. Alternatively, the EGM 400 can be configured in the first communication mode to filter or modify messages or commands passed between the peripheral device and an external system; the EGM 400 can be configured in the first communication mode to interpose new or augmented messages or commands passed between the peripheral device and an external system; the EGM 400 can be configured in the first communication mode to transcode, translate, re-order, delay, re-source, or redirect messages or commands passed between the peripheral device and an external system; the EGM 400 can be configured in the first communication mode to add, modify, or delete messages or commands passed between the peripheral device and an external system. In general, the EGM 400 can be configured in the first communication mode to actively participate in the control or communication with the peripheral device. This active participation in the control or communication with the peripheral device in the first communication mode stands in contrast to the second communication mode where the EGM 400 is configured to passively pass through data between the peripheral device and the external system.

At some point as determined by the External System, the External System can command the EGM 400 to switch to the second communication mode. In a particular embodiment, this command to switch to a second communication mode takes the form of a request sent to the EGM 400 by the External System via a messaging layer on top of the normal communication channel. Using this request for the second communication mode, the External System can request control of a particular peripheral device 412.

Figure 6:
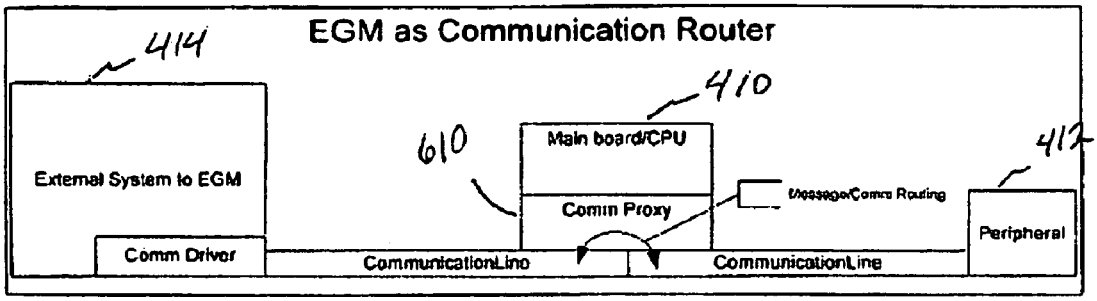
FIG. 6 illustrates a second communication mode between an external system and a peripheral device via a processor of the EGM.

In response to the request for the second communication mode, the EGM 400 relinquishes control of the requested peripheral device 412 by shutting down the first communication mode and establishing, through the same underlying communication link, the second mode of communication, which is facilitated by the Communication Proxy 610 of EGM 400 as shown in FIG. 6. In a particular embodiment, the first communication mode corresponds to a first conventional data communication protocol and the second communication mode corresponds to a second conventional data communication protocol. Note again that any of the components illustrated in FIGS. 4-6, including control module 511 and communication proxy 610 can include or be implemented in hardware, firmware, and/or software embodiments for performing the operations described herein.

In a particular embodiment, the EGM 400 can include the option of either shutting down first communication mode or keeping the first communication mode in a normal operation mode as in normal polling for status without any negative effects to the first communication mode.

In response to the request for the second communication mode, the Communication Proxy 610 of EGM 400 is activated and takes control of communication links 510 and 512 over control module 511. The Communication Proxy 610 is configured to actively pass through all communication between the External System via external system interface 414 and the peripheral device 412. As such, the Communication Proxy 610 takes the role of a communication router and is no longer in control of the peripheral device 412. The External System via external system interface 414 is then communicating with the peripheral device 412 through the Communication Proxy 610. In the second communication mode, the EGM 400 doesn't attempt to decode the content of the communication between the External System and the peripheral device 412. In the second communication mode, the EGM 400 therefore doesn't know what is being sent to the peripheral device 412 by the External System.

Referring still to FIG. 6, when the External System is finished with the direct control of the peripheral device 412 in the second communication mode, the External System can request the EGM 400 to switch back to the first communication mode. In a particular embodiment, this command to switch back to the first communication mode takes the form of a request sent to the EGM 400 by the External System via a messaging layer on top of the normal communication channel. Using this request for the first communication mode, the External System can relinquish direct control of a particular peripheral device 412.

In response to the request for the first communication mode, the EGM 400 re-establishes control of the affected peripheral device 412 by shutting down the Communication Proxy 610 and returning control of data communication links 510 and 512 to the control module 511. In this manner, EGM 400 regains control of the peripheral device 412 and resumes any operation needed on the peripheral device 412 as if the peripheral device 412 was a new device being activated on the EGM 400.

Figure 7:
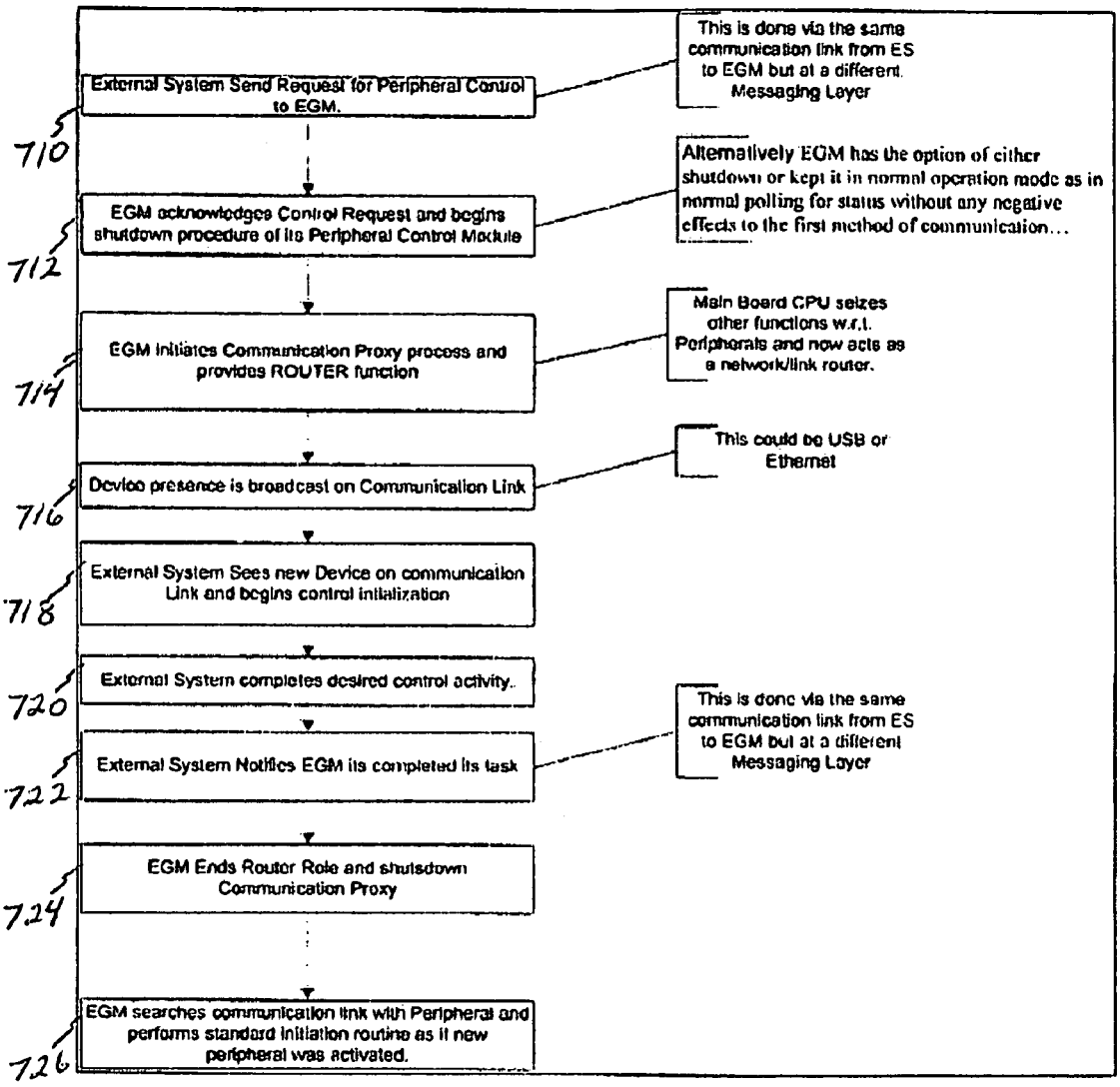
FIG. 7 is a flow diagram illustrating an example process for an example embodiment.

Referring to FIG. 7, a flow diagram illustrates an example process for an example embodiment. In processing block 710, the External System can command the EGM 400 to switch to a second communication mode. In a particular embodiment, this command to switch to a second communication mode takes the form of a request sent to the EGM 400 by the External System via a messaging layer on top of the normal communication channel. Using this request for the second communication mode, the External System can request control of a particular peripheral device 412. In processing block 712, the EGM 400 acknowledges the request to switch to a second communication mode sent by the External System. In response to the request for the second communication mode, the EGM 400 relinquishes control of the requested peripheral device 412 by shutting down the first communication mode and establishing, through the same underlying communication link, the second mode of communication, which is facilitated by the Communication Proxy 610 of EGM 400. In processing block 714, the Communication Proxy 610 of EGM 400 is activated and takes control of communication links 510 and 512 over control module 511. The Communication Proxy 610 is configured to actively pass through all communication between the External System via external system interface 414 and the peripheral device 412. The Communication Proxy 610 and thus the EGM 400 takes the role of a communication router and is no longer in control of the peripheral device 412. In processing block 716, the presence of the peripheral device 412 is broadcast on the communication link (e.g. USB, Ethernet, etc.). Note that the communication link may be implemented using conventional data communication technologies, including wired technologies such as USB, serial, parallel, Ethernet, Ethernet-Over-Power; or wireless technologies, such as Bluetooth, 802.11x, zigbee, wireless USB, and/or other forms of conventional wired, wireless, or optical data communication technologies. In processing block 718, the External System sees the presence of the peripheral device 412 as broadcast on the communication link. The External System begins control initialization of the peripheral device 412. In processing block 720, the External System completes its direct control of the peripheral device 412 in the second communication mode. In processing block 722, the External System can request the EGM 400 to switch back to the first communication mode. In a particular embodiment, this command to switch back to the first communication mode takes the form of a request sent to the EGM 400 by the External System via a messaging layer on top of the normal communication channel. In processing block 724, the External System can relinquish direct control of a particular peripheral device 412. The EGM 400 terminates its role as a communication router in the second communication mode and re-establishes control of the affected peripheral device 412 by shutting down the Communication Proxy 610 and returning control of data communication links 510 and 512 to the control module 511. In this manner, EGM 400 regains control of the peripheral device 412 and resumes any operation needed on the peripheral device 412. In processing block 726, the EGM 400 searches the communication link for the peripheral device 412 and performs standard initialization routines as if the peripheral device 412 was being newly activated. In this manner, the first communication mode is re-established.

In the foregoing description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the claims.

Each of the embodiments described herein are contemplated as falling within the inventive subject matter, which is set forth in the claims.

What is claimed is:

1. An electronic wagering game machine comprising:

a central processing unit (CPU);

at least one peripheral device in data communication with the CPU; and a data communication interface in data communication with the CPU to enable data communication with an external system via an external system interface, the data communication interface including a first communication mode to control data communication between the external system and the at least one peripheral device, the first communication mode being configurable to cause the data communication interface to perform an operation from the group: augment, interpose, redirect, add, or delete a message passed between the peripheral device and the external system, the data communication interface including a second communication mode to enable a communication proxy that optionally relinquishes control of the data communication between the external system and the at least one peripheral device.

2. The electronic gaming machine as claimed in claim 1 wherein the communication proxy passes through data communication between the external system and the at least one peripheral device without decoding the associated data.

3. The electronic gaming machine as claimed in claim 1 wherein the data communication interface being further configured to receive a command from the external system to switch to the second communication mode.

4. The electronic gaming machine as claimed in claim 1 wherein an activation of the second communication mode causes a deactivation of the first communication mode.

5. The electronic gaming machine as claimed in claim 1 further including a control module in data communication with the CPU to control data communication between the external system and the at least one peripheral device while the first communication mode is active.

6. The electronic gaming machine as claimed in claim 1 wherein the external system can directly control the at least one peripheral device in the second communication mode.

7. The electronic gaming machine as claimed in claim 1 wherein the data communication interface being further configured to receive a command from the external system to switch to the first communication mode.

8. The electronic gaming machine as claimed in claim 1 wherein an activation of the first communication mode causes a deactivation of the second communication mode.

9. The electronic gaming machine as claimed in claim 1 wherein the CPU does not control data communication with the at least one peripheral device in the second communication mode.

10. An electronic wagering game system comprising:

a central processing unit (CPU);

at least one peripheral device in data communication with the CPU;

an external system;

an external system interface; and a data communication interface in data communication with the CPU to enable data communication with the external system via the external system interface, the data communication interface including a first communication mode to control data communication between the external system and the at least one peripheral device, the first communication mode being configurable to cause the data communication interface to perform an operation from the group: augment, interpose, redirect, add, or delete a message passed between the peripheral device and the external system, the data communication interface including a second communication mode to enable a communication proxy that optionally relinquishes control of the data communication between the external system and the at least one peripheral device.

11. The electronic gaming system as claimed in claim 10 wherein the communication proxy passes through data communication between the external system and the at least one peripheral device without decoding the associated data.

12. The electronic gaming system as claimed in claim 10 wherein the data communication interface being further configured to receive a command from the external system to switch to the second communication mode.

13. The electronic gaming system as claimed in claim 10 wherein an activation of the second communication mode causes a deactivation of the first communication mode.

14. The electronic gaming system as claimed in claim 10 further including a control module in data communication with the CPU to control data communication between the external system and the at least one peripheral device while the first communication mode is active.

15. The electronic gaming system as claimed in claim 10 wherein the external system can directly control the at least one peripheral device in the second communication mode.

16. The electronic gaming system as claimed in claim 10 wherein the data communication interface being further configured to receive a command from the external system to switch to the first communication mode.

17. The electronic gaming system as claimed in claim 10 wherein an activation of the first communication mode causes a deactivation of the second communication mode.

18. The electronic gaming system as claimed in claim 10 wherein the CPU does not control data communication with the at least one peripheral device in the second communication mode.

19. A method comprising:

configuring a data communication interface in data communication with a central processing unit (CPU) to enable data communication with an external system via an external system interface;

configuring the data communication interface to include a first communication mode to control data communication between the external system and at least one peripheral device, the first communication mode being configurable to cause the data communication interface to perform an operation from the group: modify, augment, interpose, redirect, add, or delete a message passed between the peripheral device and the external system;

configuring the data communication interface to include a second communication mode to enable a communication proxy that optionally relinquishes control of the data communication between the external system and the at least one peripheral device; and receiving a command from the external system to switch from the first data communication mode to the second communication mode.

20. The method as claimed in claim 19 wherein the communication proxy passes through data communication between the external system and the at least one peripheral device without decoding the associated data.

21. The method as claimed in claim 19 wherein an activation of the second communication mode causes a deactivation of the first communication mode.

22. The method as claimed in claim 19 wherein the external system can directly control the at least one peripheral device in the second communication mode.

23. The method as claimed in claim 19 further including receiving a command from the external system to switch to the first communication mode.

24. The method as claimed in claim 19 wherein an activation of the first communication mode causes a deactivation of the second communication mode.

25. The method as claimed in claim 19 wherein the CPU does not control data communication with the at least one peripheral device in the second communication mode.

* * * * *

UNITED STATES PATENT AND TRADEMARK OFFICE

CERTIFICATE OF CORRECTION

PATENT NO. : 8,360,888 B2
APPLICATION NO. : 12/442296
DATED : January 29, 2013
INVENTOR(S) : Phan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 626 days.

Signed and Sealed this
First Day of September, 2015

Michelle K. Lee

Michelle K. Lee
*Director of the United States Patent and Trademark Office*